US005145176A

United States Patent [19]

Lipson

[11] Patent Number: 5,145,176

[45] Date of Patent: Sep. 8, 1992

[54] PNEUMATICALLY OPERATED GOLF BALL TEE

[76] Inventor: Earl Lipson, 164 Lyndhurst Ave., Toronto, Ontario, M5R 2Z9, Canada

[21] Appl. No.: 738,566

[22] Filed: Jul. 31, 1991

[51] Int. Cl.[5] ..... A63B 57/00

[52] U.S. Cl. ..... 273/201; 273/26 R; 273/29 A; 273/399

[58] Field of Search ..... 273/26 R, 29 R, 29 A, 273/33, 399, 860, 30, 119 B, 201; 446/479, 178, 179, 132; 124/56, 57, 58, 59, 60, 70, 71, 72

[56] References Cited

U.S. PATENT DOCUMENTS

| | | | |
|---|---|---|---|
| 3,887,349 | 6/1975 | Breslow | 124/56 |
| 3,905,349 | 9/1975 | Nielsen et al. | 124/56 |
| 4,207,349 | 9/1975 | Balka, Jr. | 124/56 |
| 4,272,078 | 6/1981 | Vinette | 124/56 |
| 4,564,195 | 1/1986 | McClure et al. | 273/26 R |
| 4,741,537 | 5/1988 | Adam | 273/201 |
| 5,011,144 | 4/1991 | Merello | 273/26 R |

FOREIGN PATENT DOCUMENTS

| | | | |
|---|---|---|---|
| 3428409 | 2/1986 | Fed. Rep. of Germany | 273/29 A |
| 813051 | 5/1937 | France | 273/399 |
| 2258353 | 2/1974 | France | 273/399 |
| 2057893 | 4/1981 | United Kingdom | 124/56 |

*Primary Examiner*—Theatrice Brown

[57] ABSTRACT

A pneumatically operated golf ball tee system of the present invention comprises an upwardly opening ball and air guide through which the ball passes and above which the ball is pneumatically supported when in a teed position. The system further includes a source of golf balls, a control for ball entry from the source to the guide and an air supply providing pressurized air upwardly through the guide.

6 Claims, 5 Drawing Sheets

PNEUMATICALLY OPERATED GOLF BALL TEE

FIELD OF THE INVENTION

The present invention relates to a golf ball tee system in which a source of golf balls feeds to a pneumatically operated tee using a stream of air for holding a golf ball in a teed position.

BACKGROUND OF THE INVENTION

Golf is becoming a more and more popular sport. Driving ranges are often used as a practice area for many golfers. Most driving ranges use a simulated grass mat having a rubber tee for supporting a golf ball in a teed position. As a result of continuous use, even these rubber tees become damaged and incapable of supporting a golf ball.

The traditional driving range rubber tee is set at one height only and therefore not suitable for use with both woods and irons, i.e. if the tee is set at appropriate height for use with a wood, it is too high to be used with an iron. If on the other hand the tee is set for use with an iron, it is too low to be used with a wood.

When practicing at a traditional driving range mat, including a standard rubber tee, the person using the mat must release the club and move away from the set up position after each and every hit in order to bend down, pick up a new ball and place it on the tee. This severely detracts from the persons ability to repeat each swing as is highly desireable for practice purposes.

SUMMARY OF THE PRESENT INVENTION

The present invention provides a pneumatically operated golf ball system which overcomes the drawbacks noted above. This pneumatically operated system comprises an upwardly opening ball and air guide through which the ball passes and above which the ball is pneumatically supported when in a teed position. It further includes a source of golf balls, means for controlling ball entry from the source to the guide and air supply means providing pressurized air upwardly through the guide.

Through the use of pressurized air for supporting the ball in a teed position, the requirement for a standard rubber tee subject to damage as earlier described is eliminated. The feeding of the balls from the source to the guide allows the player to hold onto the club and to maintain set up position without having to bend down and place a ball on the tee.

According to an aspect of the invention the pressure at the air supply means is adjustable by the person using the tee to vary the height setting of the ball in the teed position to accommodate both woods and irons.

BRIEF DESCRIPTION OF THE DRAWINGS

The above as well as other advantages and features of the present invention will be described in greater detail according to the preferred embodiments of the present invention in which.

Figure 2:
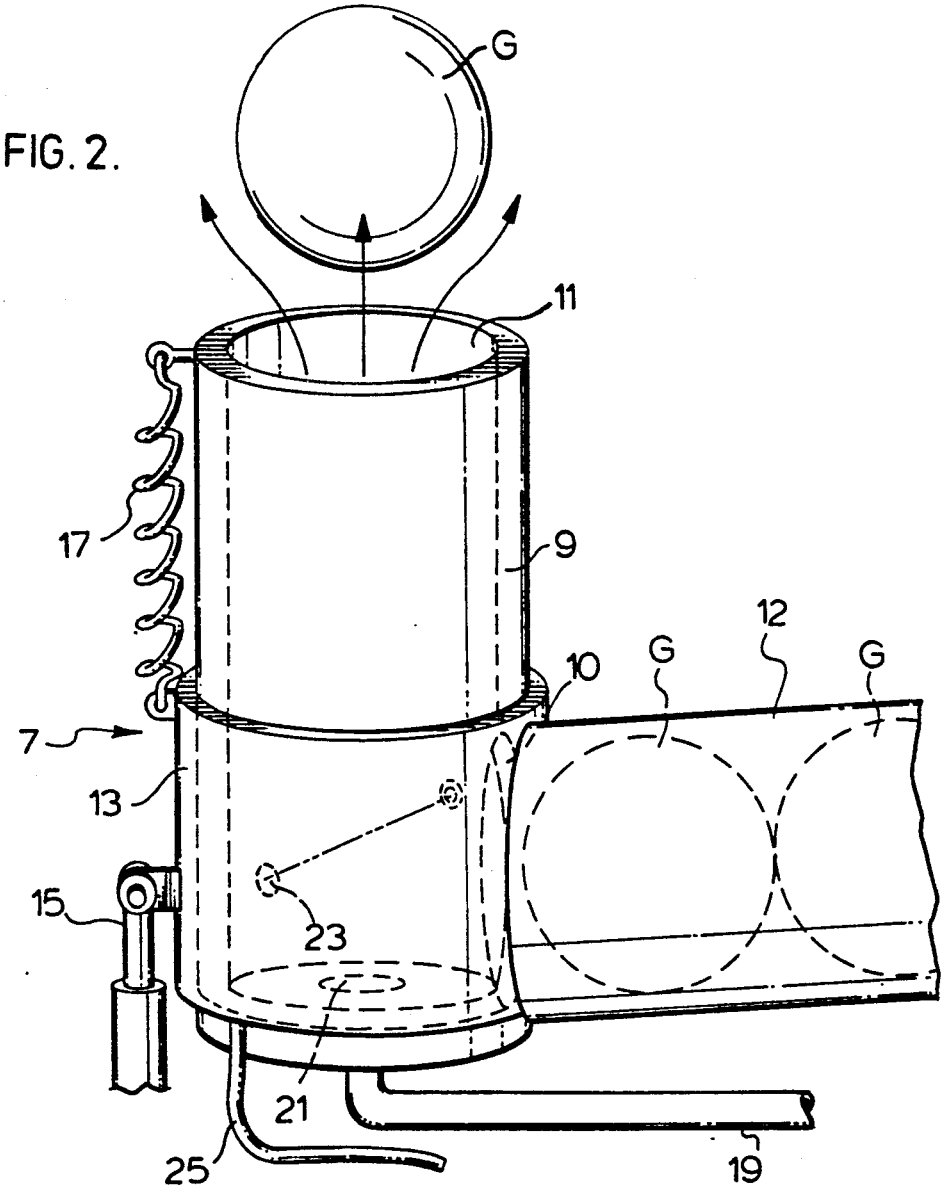
FIG. 2 is an enlarged perspective view of the actual tee area from the set up or system of FIG. 1.
Figure 1:
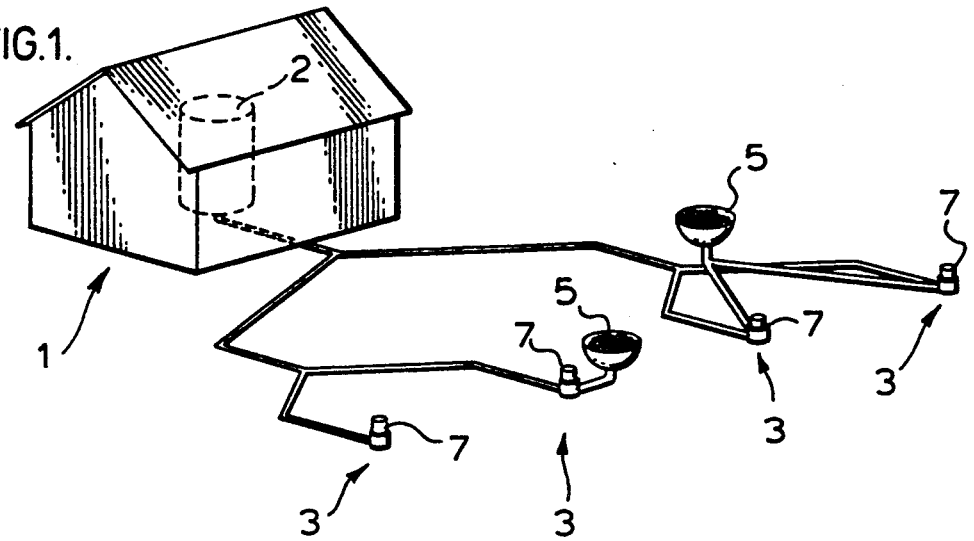
FIG. 1 is a perspective view of a driving range set up using sources of golf balls feeding to pneumatic tees according to a preferred embodiment of the present invention.
Figure 3:
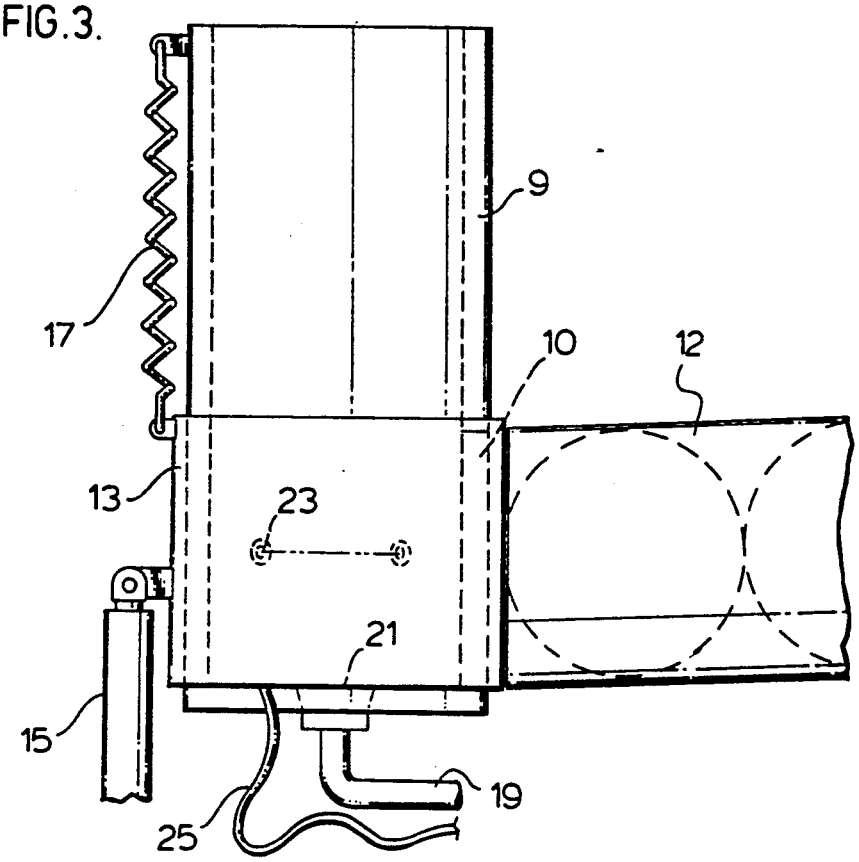
FIG. 3 is a side view of the tee area shown in FIG. 2 in an non-operating position.

DETAILED DESCRIPTION ACCORDING TO THE PREFERRED EMBODIMENTS OF THE PRESENT INVENTION IN WHICH:

FIG. 1 shows an overall driving range set up generally indicated at 1. This set up includes hitting areas generally indicated at 3. Each one of those hitting areas includes a source of golf balls 5 automatically feeding to a pneumatic tee 7. The source of golf balls is preferably in the form of a large hopper or bag which is preloaded before using the tee and which includes a supply line from the hopper to the pneumatic tee.

Also shown in FIG. 1 is a large compressor 2 which provides a source of pressurized air to operate each of the tees 7 and to be described later in detail.

An individual tee area 7 is shown in FIGS. 2 through 6 of the drawings. This tee comprises an upright ball and air guide 9. Guide 9 is preferably in the form of a cylindrical tube as shown in the drawings. This tube is hollow and includes a top opening 11. The size of the tube is such that its interior diameter accommodates the travel of a standard golf ball G upwardly through the tube.

A ball delivery or supply line 12 extends from the source of golf balls 5 to the tube 9. The golf ball source is elevated relative to the tee and therefore supply line 12 is preferably designed for a gravity feed of the balls from the source to the tee. It could also be a forced supply of balls to the tube using for example air pressure, already in the system, to move the balls along the supply line.

In the preferred embodiment shown in FIGS. 2 through 6 of the drawings a movable collar 13 is slideably fitted over tube 9. This collar when in a down position as shown in FIGS. 2, 3, 5 and 6 is located around the base of the tube between the tube inlet 10 and the end of the supply line 12. Therefore, in the down position, sleeve 13 blocks entry of the balls from the supply line to the ball and air guide tube.

Figure 4:
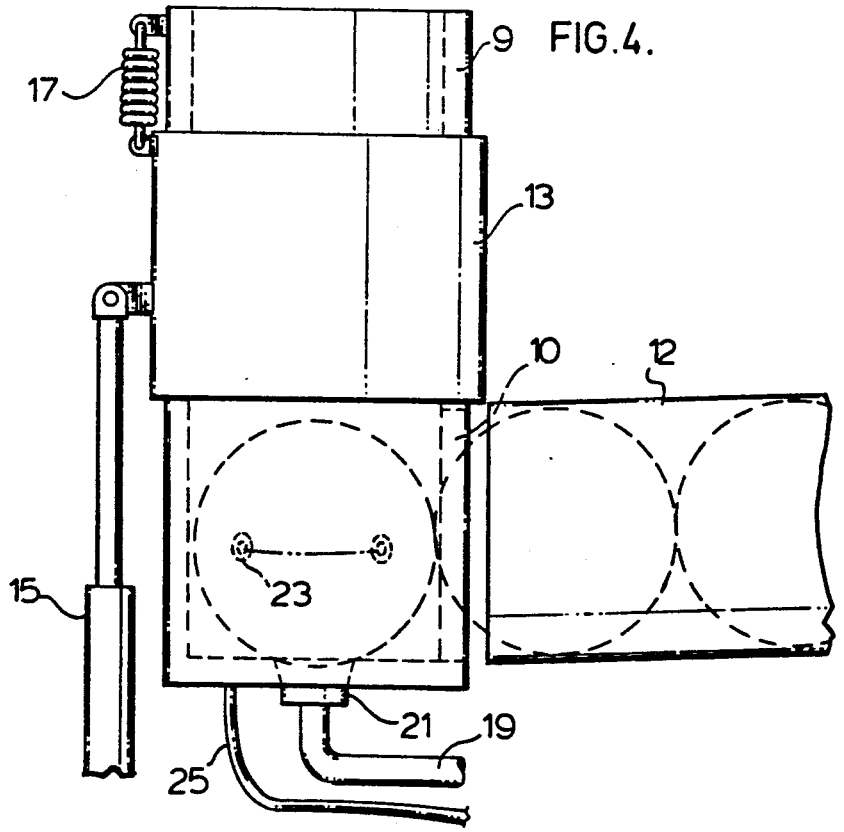
FIG. 4 is a view similar to FIG. 3 showing the feeding of a golf ball to the tee area.
Figure 5:
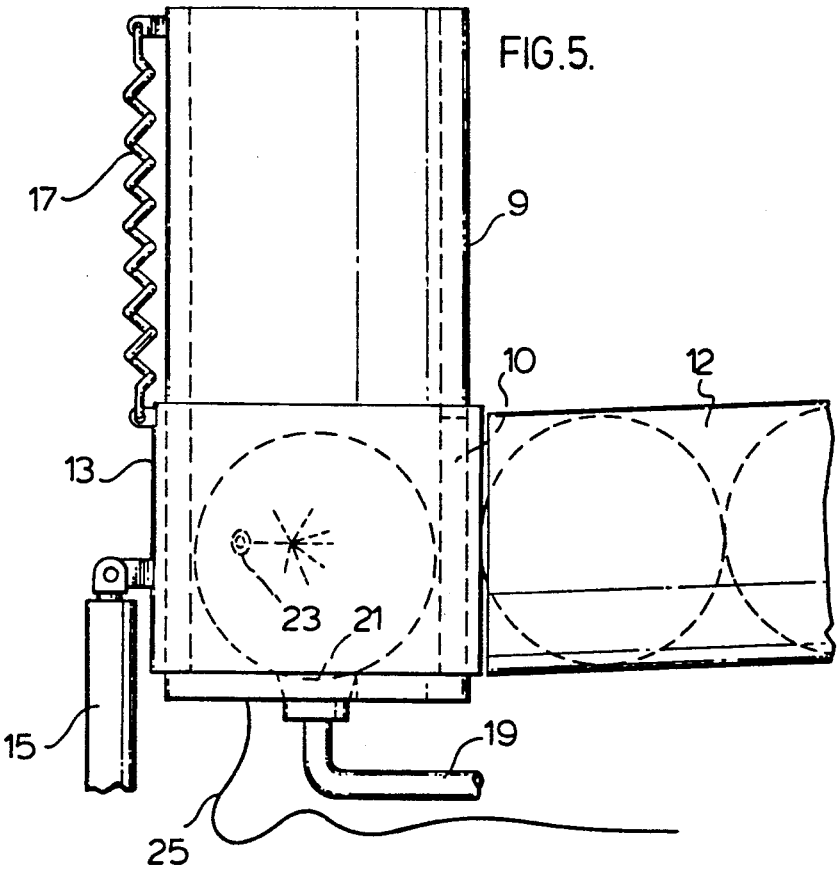
FIG. 5 is a view similar to FIG. 4 showing further operation of the tee.

When the sleeve is moved to an up position as shown in FIG. 4 of the drawings, the tube inlet 10 is exposed to the supply line 12 so that the lowermost ball in the supply line simply rolls into the tube. After the tube has been fed with a ball in this manner the sleeve moves back to its down position as shown in FIG. 5 to block the further flow of balls into the tube until the ball in the tube has been hit clearing the tube for the next ball.

Provided to one side of the sleeve 13 is an air piston 15 as well as a coil spring 17. The air piston and coil spring cooperate with one another to provide the up and down movement of the sleeve to be described later in detail.

Provided interiorly of tube 9 is a ball sensor 23 which in this case is electrically powered through line 25. This ball sensor is preferably in the form of some type of a light sensor with a sight line across the tube which is clear when there is no ball and which is interrupted when there is a ball in the tube.

An air supply line 19 from the compressor 2 terminates with an air jet 21 at the base of the ball and air guide tube 9.

The operation of the tee is as follows. Sleeve 13 is held in an up position on the tube 9 by spring 17 as shown in FIG. 4. This exposes the tube inlet 10 to the supply line 12 so that the last ball in the supply line rolls into the base of the tube. Sensor 23 senses the presence of the ball in the tube which initiates a number of positive action steps, the first of which is the pulling down of sleeve 13 along the tube by air operated piston 15. This step is shown in FIG. 5 of the drawings. With the sleeve in a down position, ball entry 10 is cut off from the supply line 11 so that no further balls can enter the tube until the sleeve has been lifted back to its up position.

Figure 6:
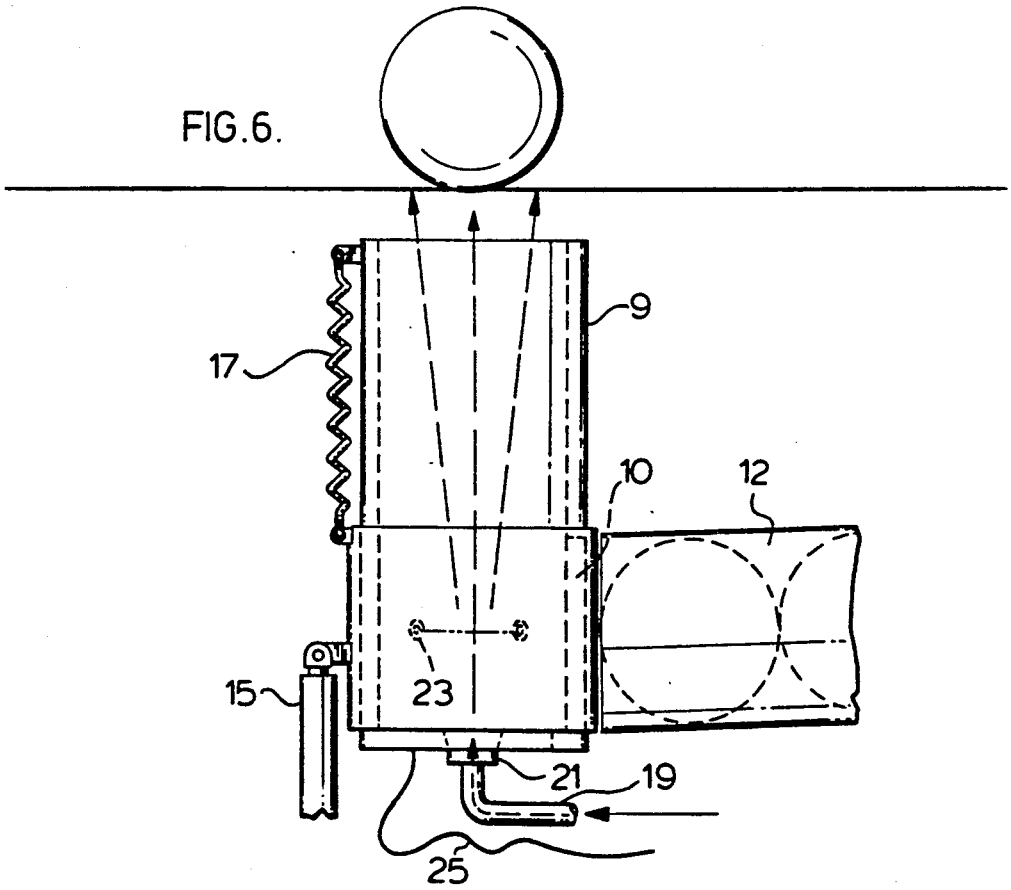
FIG. 6 is a side view of the tee shown in FIG. 2.

With sleeve 10 in a down position and a ball located within tube 9, a supply of pressurized air from compressor 2 is fed along air supply line 19 and into the tube 9 by means of air jet 21. The ball is then forced upwardly through the tube by the pressurized air. Here it should be noted that the fit of the ball in the tube, although not snug enough to inhibit ball movement through the tube is sufficiently tight to effectively prevent the escape of the air upwardly around the ball. Therefore, essentially all of the air acts directly on the ball for lifting it to its teed position where it is held elevated above the tube as shown in FIG. 6 of the drawings.

The supply of pressurized air to hold the ball in the teed position is continued for a length of time sufficient to enable the golfer to set up and hit the ball. Sleeve 10 remains in the down position during this period to prevent any further balls from entering the tube. If the ball is not hit from its teed position, it simply drops back down into the tube. Sensor 23 then senses the presence of this reloaded ball whereby collar or sleeve 10 remains in its down position and continues to block the entry of any further balls from the supply tube. If on the other hand the ball is hit from the tee, sensor 23 senses an empty tube which causes piston 15 to release and allow spring 17 to pull the sleeve upwardly opening tube inlet 10 and allowing the next inline ball from the supply line to roll into tube 9. Sensor 23 senses the presence of a new ball causing piston 15 to pull sleeve 13 downwardly and once again block the ball inlet 10 to tube 9. At this point, the pressurized air is reintroduced along line 19 and through nozzle 21 to lift the new ball upwardly through the air and ball guide tube.

The sequence or steps of operation of the tee are then repeated as long as the player continues to use the tee.

A very interesting feature of the present invention is that the tee will not allow the introduction of more than one ball at any one time to the tube 9. As noted above, if the ball which has already been elevated to the teed position by the air pressure drops back down into the tee, this same ball is sensed by sensor 23 holding sleeve 10 in its down position and blocking the supply line 12 to tube 9. This allows the player to take as many practice swings or as much set up time as is necessary without having to worry about having to hit the ball off the tee. In addition, the timing circuit for the tee which will be described later in detail is adjustable by the user according to how quickly he or she wants the next ball to come up onto the tee. Furthermore, because the person using the tee does not have to manually load the ball onto the tee, he or she can continue to swing holding the same set up or grip which can then easily be repeated by that person. This particular feature is considered to be very beneficial for teaching purposes where the golf professional would like to see the student repeat a particular swing as often as possible in a relatively timely fashion.

Another feature of the system is that the amount of air pressure delivered to the tee is adjustable by the user. A lower amount of air pressure results in the ball sitting in a lower teed position possibly only slightly elevated from the top of tube 9 and useable with an iron whereas higher air pressure forces a ball into a higher teed position useable with a wood.

Figure 7:
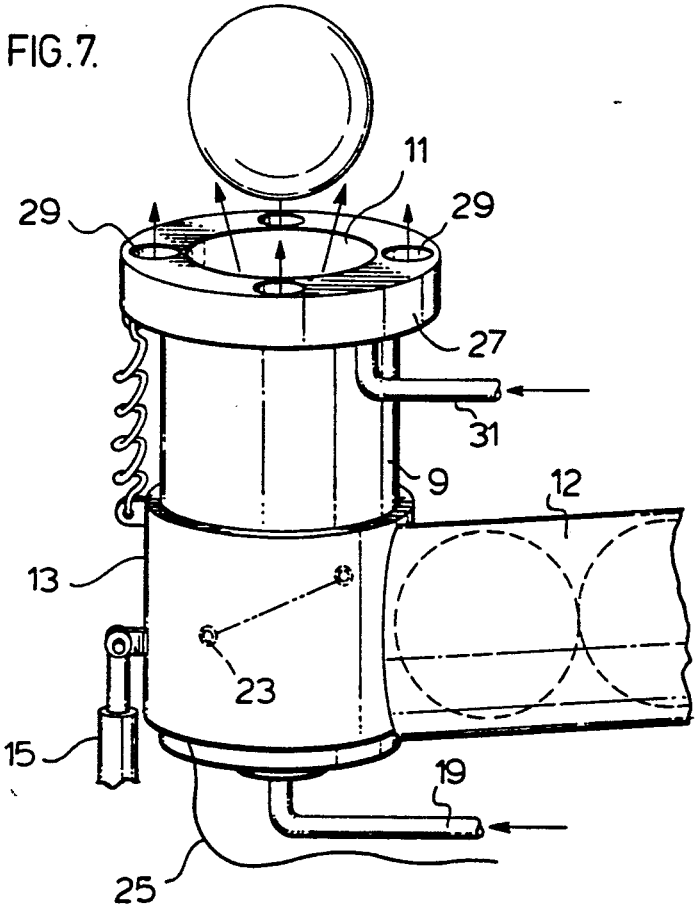
FIG. 7 is a perspective view of a further tee area according to another preferred embodiment of the present invention.

FIG. 7 of the drawings shows a tee similar in almost all respects to the tee shown in FIG. 6 except that the tee in FIG. 7 includes an additional collar 27. This collar is connected to its own air supply line 31 and includes a plurality of upwardly opening peripheral air jets 29.

The sequence for operation of the tee shown in FIG. 7 is substantially the same as that earlier described with respect to the tee of FIGS. 2 through 6 except that with the tee of FIG. 7, rather than having a single column of air forced up through tube 9, there are additional peripheral jets of air fed upwardly through jets 29. These peripheral jets of air provide an additional guide around and steadying the golf ball in its teed position elevated above the tee.

Figure 8:
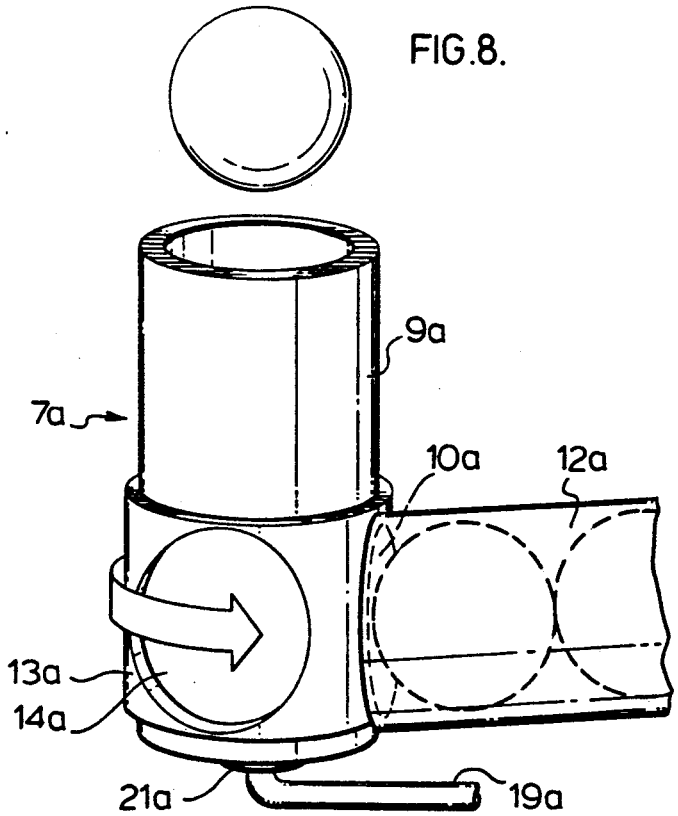
FIG. 8 is a perspective view of another tee according to a preferred embodiment of the present invention.

FIG. 8 shows a further embodiment of the present invention in the form of a tee generally indicated at **7*a*. This tee includes a ball and air guide tube 9*a* having a ball entry 10*a* and fed via a supply line 12*a*. It further includes an air pressure line 19*a* feeding a jet or nozzle 21*a* at the base of tube 9*a***.

Not shown in FIG. 8 is an internal sensor within the tube identical to sensor 23 described above.

The difference between tee **7*a* and tee 7 as earlier described is that tee 7*a* includes a rotatable collar or sleeve 13*a* having a ball port 14*a*. Sleeve 13*a* rather than moving up and down relative to tube 9*a* rotates on the tube to open and close the tube entry 10*a*. The sequence for rotation of sleeve 13*a* is however identical to the sequence for sliding of collar 13 as earlier described, i.e. rotational sleeve 13*a* is responsive to the internal ball sensor and will only move ball port 14*a* into alignment with tube entry 10*a* when no ball is sensed interiorly of the tube. If there is a ball within the tube, then the sleeve rotates to a position such as that shown in FIG. 8 where ball port 14*a* is out of alignment with tube entry 10*a* thereby closing the tube from the supply line 12*a***.

Figure 9:
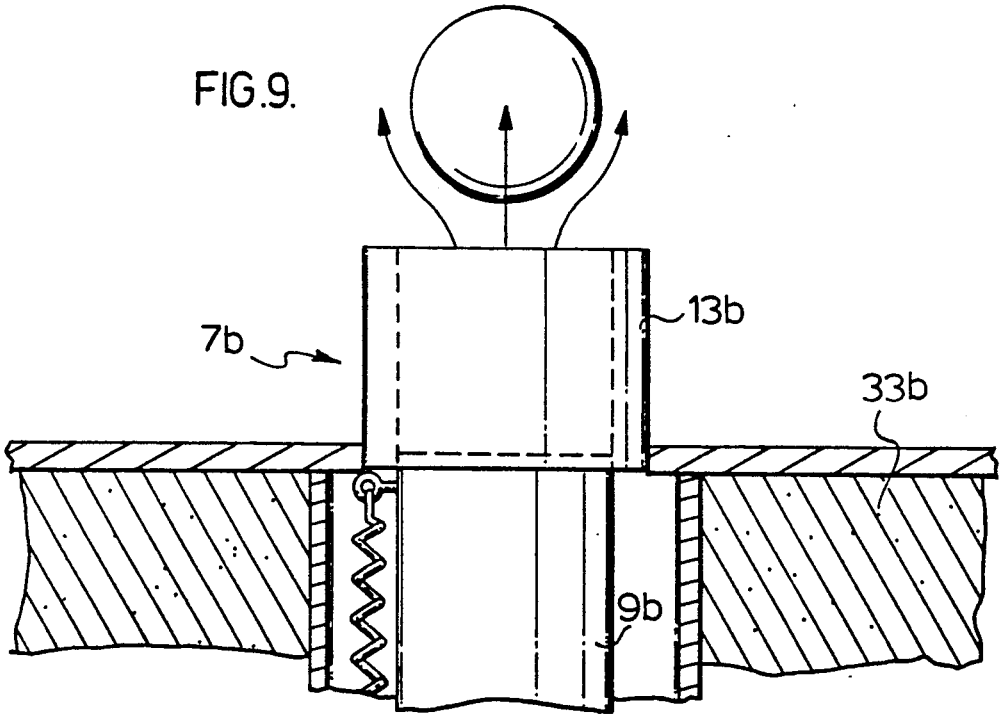
FIG. 9 is a side view of still another preferred embodiment of the present invention.

FIG. 9 of the drawings shows a further preferred embodiment tee generally indicated at **7*b*. This tee is shown as being located at a typical driving range mat 33*b*. It includes a ball and air guide tube 9*b* with a collar 13*b* sleeved over tube 9*b*. In this particular arrangement, collar 13*b* rises to a height where it extends above the upper end of tube 9*b*. In the earlier described embodiments, the components making up the actual physical construction of the tee are intended to be located below ground level with the stream of air holding the ball above the mat surface. In the FIG. 9 arrangement, sleeve 13*b* extends above the driving range mat with the stream of air as shown holding the ball above the sleeve in a teed position. In order to eliminate or at least minimize damage to the sleeve it is preferably constructed from a soft plastic or rubber material which is essentially damage resistant if hit by a golf club. Furthermore, and unlike a conventional tee, the ball does not sit directly atop sleeve 13***b* so that the person practicing if making proper contact with the ball will generally not hit the sleeve whatsoever.

Figure 10:
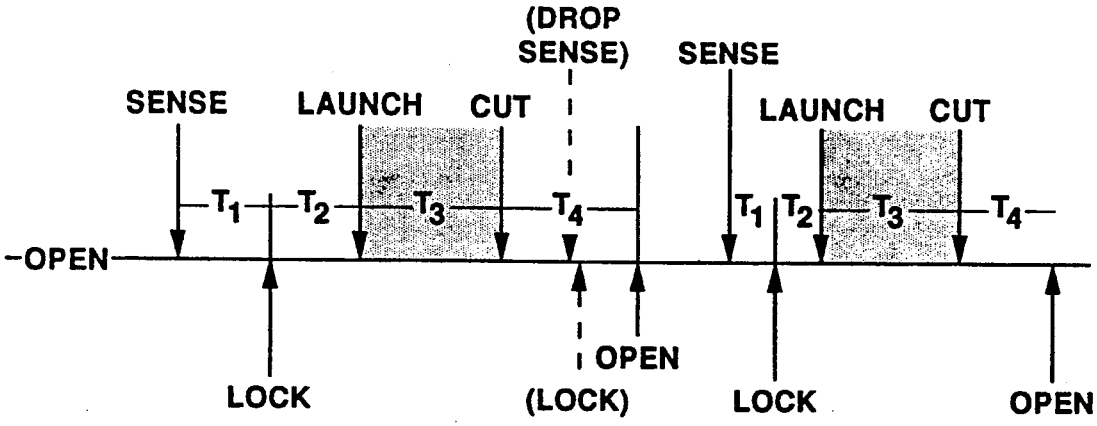
FIG. 10 is a chart showing a preferred sequence of operation for any one of the tee areas shown in FIGS. 2 through 9 of the drawings.

FIG. 10 of the drawings shows a preferred electrically controlled timed operation for any one of the tees described in FIGS. 2 through 9 of the drawings. This sequence of operation is repeated for each golf ball hit or at least entered to the tee.

The timing control starts with an open phase in which all the pneumatic feed to that particular tee is shut down. Next there is the sensing phase where the light sensor senses whether or not a ball is in the air and ball guide tube. As noted above, this ball could be entered either from the source through the supply line or it could be a ball which if not hit by the person using the tee, which is simply dropped back down from the teed position into the tube.

The sense phase triggers all the functions of the tee and initiates a timer sequence T1 and T2. At the end of time T1, which is the time taken to sense whether or not a ball is present, there is a lock phase where, for the tees shown in FIGS. 3 through 7 and 9 of the drawings, the air piston drives the ball entry control sleeve to a down position cutting the supply line off from the tube. In the case of the FIG. 8 tee, the lock phase causes the rotational sleeve to rotate to a position to cut the supply line off from the tube inlet.

After the lock phase, and following the timing of period T2, there is a launch phase. This launch phase starts the air from the main compressor to effectively launch the ball upwardly from the ball and air guide tube to the tee position above the tube. In the case of the tee shown in FIG. 7 of the drawings, the separate peripheral air guide nozzles are activated during the launch phase.

The launch phase continues for a time period T3. This time period substantially longer than periods T1 and T2 where the launch will be maintained for a sufficient amount of time for the person using the tee to set up and hit the ball. As earlier noted, this launch phase is adjustable and is controlled by the person using the tee. A typical launch time would be for example anywhere from 5 to 10 seconds.

Following the launch time, there is a cut phase in which the air jets are shut down. The sensor then takes over to determine whether or not the teed ball has dropped back down into the tube. Throughout the launch phase, the locked position of the sleeve is maintained and if the sensor determines that the ball has in fact dropped down from the teed position into the tube, the lock phase is continued. If on the other hand after a period of time T4, the sensor senses that the tube is empty and therefore that the teed ball has been hit, the sequence moves onto the open phase at which point the entire sequence as described immediately above is repeated.

It will now be seen how the pneumatically operated tee of the present invention eliminates the need for physical placement of a ball on a tee as found in a conventional driving range set up and therefore allows the person using the tee to maintain a stance and grip from one swing to the next. This is very beneficial from a practicing standpoint. Furthermore, the tee of the present invention does not run into the problems of tee damage as also found with a conventional driving range set up. In addition, by varying the air pressure to the tee, the height of the teed ball can be adjusted for different club selections.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A pneumatically operated golf ball tee system comprising an upwardly opening ball and air guide through which a ball passes and above which the ball is pneumatically supported when in a teed position, a source of golf balls, a supply line from said source to said guide, means for controlling ball entry from said source to said guide and air supply means providing pressurized air upwardly through said guide, said system including ball sensing means interiorly of said guide, said means for controlling ball entry being responsive to said ball sensing means to open said guide to said source when no ball is sensed within said guide and to close said guide to said source when a ball is sensed in said guide.

2. A pneumatically operated tee system as claimed in claim 1, wherein said guide comprises a vertical tube having a lower end ball inlet, said system including a collar sleeved surround said vertical tube, said collar having a ball passage therethrough and being slideable along said tube from a ball feed position in which said passage through said collar aligns with said ball inlet in said vertical tube to a block position in which said ball passage and said ball inlet are out of alignment with one another.

3. A pneumatically operated tee system as claimed in claim 1, wherein said guide comprises a vertical tube having a top located ring, said ring including a plurality of airjets providing peripheral air guide streams outwardly around the pressurized air passing upwardly through said guide.

4. A pneumatically operated tee system as claimed in claim 1, wherein said air supply means is adjustable for varying height of the ball above the tee in the teed position.

5. A pneumatically operated tee system as claimed in claim 1, wherein said guide includes a ball inlet and a collar with a ball port sleeved over said guide, said collar being rotatable on said guide to open and close said ball inlet from said source of golf balls.

6. A pneumatically operated golf ball tee system as claimed in claim 1 including a driving range mat and wherein said ball and air guide comprises a vertical tube located within said mat, said mat having an upper surface; said vertical tube terminating no higher than said upper surface of said mat and the ball when in the teed position being pneumatically supported above the upper surface of the mat.

* * * * *